US009991632B2

(12) United States Patent
Ishida et al.

(10) Patent No.: US 9,991,632 B2
(45) Date of Patent: Jun. 5, 2018

(54) LOCK MECHANISM, CONNECTOR AND WIRE HARNESS

(71) Applicant: Yazaki Corporation, Tokyo (JP)

(72) Inventors: Takuya Ishida, Tochigi (JP); Tomoyuki Miyakawa, Tochigi (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days. days.

(21) Appl. No.: 15/700,795

(22) Filed: Sep. 11, 2017

(65) Prior Publication Data

US 2018/0076565 A1 Mar. 15, 2018

(30) Foreign Application Priority Data

Sep. 13, 2016 (JP) ..... 2016-178482

(51) Int. Cl.
*H01R 13/627* (2006.01)
*H01R 24/86* (2011.01)

(52) U.S. Cl.
CPC ..... *H01R 13/6273* (2013.01); *H01R 13/6278* (2013.01); *H01R 24/86* (2013.01)

(58) Field of Classification Search
CPC ..... H01R 13/6395; H01R 13/743; H01R 13/6272; H01R 13/6273; H01R 13/6278; H01R 24/86; H01R 13/74; H01R 13/741
USPC ..... 439/354
See application file for complete search history.

(56) References Cited

U.S. PATENT DOCUMENTS 5,984,721 A * 11/1999 Self, Jr. ..... H01R 13/74 439/546
7,371,110 B2 * 5/2008 Murakami ..... H01R 13/743 439/248
7,494,374 B2 * 2/2009 Hall ..... H01R 13/748 439/564
2002/0016100 A1 * 2/2002 Okabe ..... H01R 13/62966 439/157
2007/0173112 A1 * 7/2007 Murakami ..... H01R 13/743 439/557
2008/0090426 A1 * 4/2008 Lutsch ..... H01R 13/62955 439/34
2008/0305672 A1 * 12/2008 Kodama ..... H01R 13/6273 439/357
2009/0011632 A1 * 1/2009 Ito ..... H01R 13/6272 439/357

(Continued)

FOREIGN PATENT DOCUMENTS

JP 2014-053206 A 3/2014

*Primary Examiner* — Harshad C Patel
(74) *Attorney, Agent, or Firm* — Sughrue Mion, PLLC

(57) ABSTRACT

A lock mechanism used for a connector mechanism of a wire harness includes a flange portion projecting from a connector housing in an intersection direction intersecting with an axial direction, an arm portion supported by the connector housing at a base end, extended from the connector housing to the flange portion side along the axial direction, having a free front end, and being bendable along the intersection direction, and a lock beak portion projecting from the arm portion to a side opposite to the connector housing side along the intersection direction and being lockable to a mounting panel disposed between the lock beak portion and the flange portion in the axial direction. The lock beak portion includes a plurality of lock beak portions provided along the axial direction at certain intervals.

10 Claims, 8 Drawing Sheets

(56) References Cited

U.S. PATENT DOCUMENTS

| | | | | |
|---|---|---|---|---|
| 2015/0222052 | A1* | 8/2015 | Akagi | H01R 13/743<br>439/352 |
| 2016/0131856 | A1* | 5/2016 | Annis | H01R 13/743<br>385/76 |

* cited by examiner

LOCK MECHANISM, CONNECTOR AND WIRE HARNESS

CROSS-REFERENCE TO RELATED APPLICATION(S)

The present application claims priority to and incorporates by reference the entire contents of Japanese Patent Application No. 2016-178482 filed in Japan on Sep. 13, 2016.

BACKGROUND OF THE INVENTION

1. Field of the Invention

The present invention relates to a lock mechanism, a connector and a wire harness.

2. Description of the Related Art

As conventional connectors used for, for example, a wire harness of a vehicle, Japanese Patent Application Laid-open No. 2014-053206 describes such a panel-mounted connector device that includes a first connector housing mounted to a mounting hole of a panel from a side of a direction perpendicular to the panel and a second connector housing mating with the first connector housing from the other side of the direction perpendicular to the panel through the mounting hole with the panel interposed therebetween. In this panel-mounted connector device, the first connector and the second connector are configured such that respective connector housings accommodate terminals electrically connected with the counterpart terminals when the connector housings mate with each other.

The panel-mounted connector device described in Japanese Patent Application Laid-open No. 2014-053206 can be further improved in, for example, enhancing adaptability of the lock mechanism or the like for locking each connector to the panel.

SUMMARY OF THE INVENTION

From the above-described viewpoint, the present invention aims to provide a highly adaptable lock mechanism, connector, and wire harness.

In order to achieve the above mentioned object, a lock mechanism according to one aspect of the present invention includes a flange portion that is formed in a manner projecting from a connector housing provided with a terminal along an axial direction and being capable of mating with a counterpart connector in an intersection direction intersecting with the axial direction; an arm portion that is supported by the connector housing at a base end, is extended from the connector housing to the flange portion side along the axial direction, has a free front end, and is bendable along the intersection direction; and a lock beak portion that projects from the arm portion to a side opposite to the connector housing side along the intersection direction, and is lockable to a mounting panel disposed between the lock beak portion and the flange portion in the axial direction, wherein the lock beak portion includes a plurality of lock beak portions provided along the axial direction at a certain interval.

According to another aspect of the present invention, in the lock mechanism, it is possible to configure that the arm portion includes arm portions provided in a pair along the intersection direction in a manner facing each other, the plurality of lock beak portions are provided to each of the pair of arm portions, and each of the lock beak portions is locked to the mounting panel in a state where the connector housing is inserted in a mounting hole formed in the mounting panel.

According to still another aspect of the present invention, in the lock mechanism, it is possible to configure that out of the lock beak portions, the lock beak portion disposed in the front end side has a relatively small amount of projection, and the lock beak portion disposed in the base end side has a relatively large amount of projection.

According to still another aspect of the present invention, in the lock mechanism, it is possible to configure that the flange portion includes a portion defining a through-hole through which the arm portion penetrates along the axial direction, and in a state where the lock beak portion is locked to the mounting panel, the arm portion penetrates through a mounting hole formed in the mounting panel and the through-hole along the axial direction, has the base end disposed in a side of the axial direction with respect to the mounting panel, and has the front end disposed in another side of the axial direction with respect to the mounting panel.

In order to achieve the above mentioned object, a connector according to still another aspect of the present invention includes a connector housing that is provided with a terminal along an axial direction and is matable with a counterpart connector; and a lock mechanism that is capable of locking the connector housing to a mounting panel, wherein the lock mechanism includes: a flange portion that is formed in a manner projecting from the connector housing in an intersection direction intersecting with the axial direction; an arm portion that is supported by the connector housing at a base end, is extended from the connector housing to the flange portion side along the axial direction, has a free front end, and is bendable along the intersection direction; and a lock beak portion that projects from the arm portion to a side opposite to the connector housing side along the intersection direction, and is lockable to the mounting panel disposed between the lock beak portion and the flange portion in the axial direction, and the lock beak portion includes a plurality of lock beak portions provided along the axial direction at a certain interval.

In order to achieve the above mentioned object, a wire harness according to still another aspect of the present invention includes a conductive wiring member; and a connector that is connected with the wiring member, wherein the connector includes: a connector housing that is provided with a terminal connected with the wiring member along an axial direction and is matable with a counterpart connector; and a lock mechanism that is capable of locking the connector housing to a mounting panel, the lock mechanism includes: a flange portion that is formed in a manner projecting from the connector housing in an intersection direction intersecting with the axial direction; an arm portion that is supported by the connector housing at a base end, is extended from the connector housing to the flange portion side along the axial direction, has a free front end, and is bendable along the intersection direction; and a lock beak portion that projects from the arm portion to a side opposite to the connector housing side along the intersection direction, and is lockable to the mounting panel disposed between the lock beak portion and the flange portion in the axial direction, and the lock beak portion includes a plurality of lock beak portions provided along the axial direction at a certain interval.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments according to the present invention will now be described in detail with reference to the drawings. It should be noted that the embodiments are not intended to limit the present invention. Components in the following embodiments include what are easily replaceable by the skilled person and what are substantially the same.

A first direction, a second direction, and a third direction intersecting with one another will be referred to as an "axial direction X", a "first width direction Y", and a "second width direction Z", respectively. The axial direction X, the first width direction Y, and the second width direction Z are perpendicular to one another, and the first width direction Y and the second width direction Z correspond to cross directions of the axial direction X. The axial direction X is generally a direction in which a terminal retained by a later-described connector housing is extended, more specifically, a direction along which a terminal insertion room (not illustrated) for retaining the terminal is extended and also a direction along which the terminal is inserted into the terminal insertion room. The axial direction X corresponds to a through-thickness direction of a later-described mounting panel, whereas the first width direction Y and the second width direction Z correspond to directions along which the mounting panel is extended. Each direction in the following description represents a direction with the units assembled to one another unless otherwise specified.

First Embodiment

Figure 1:
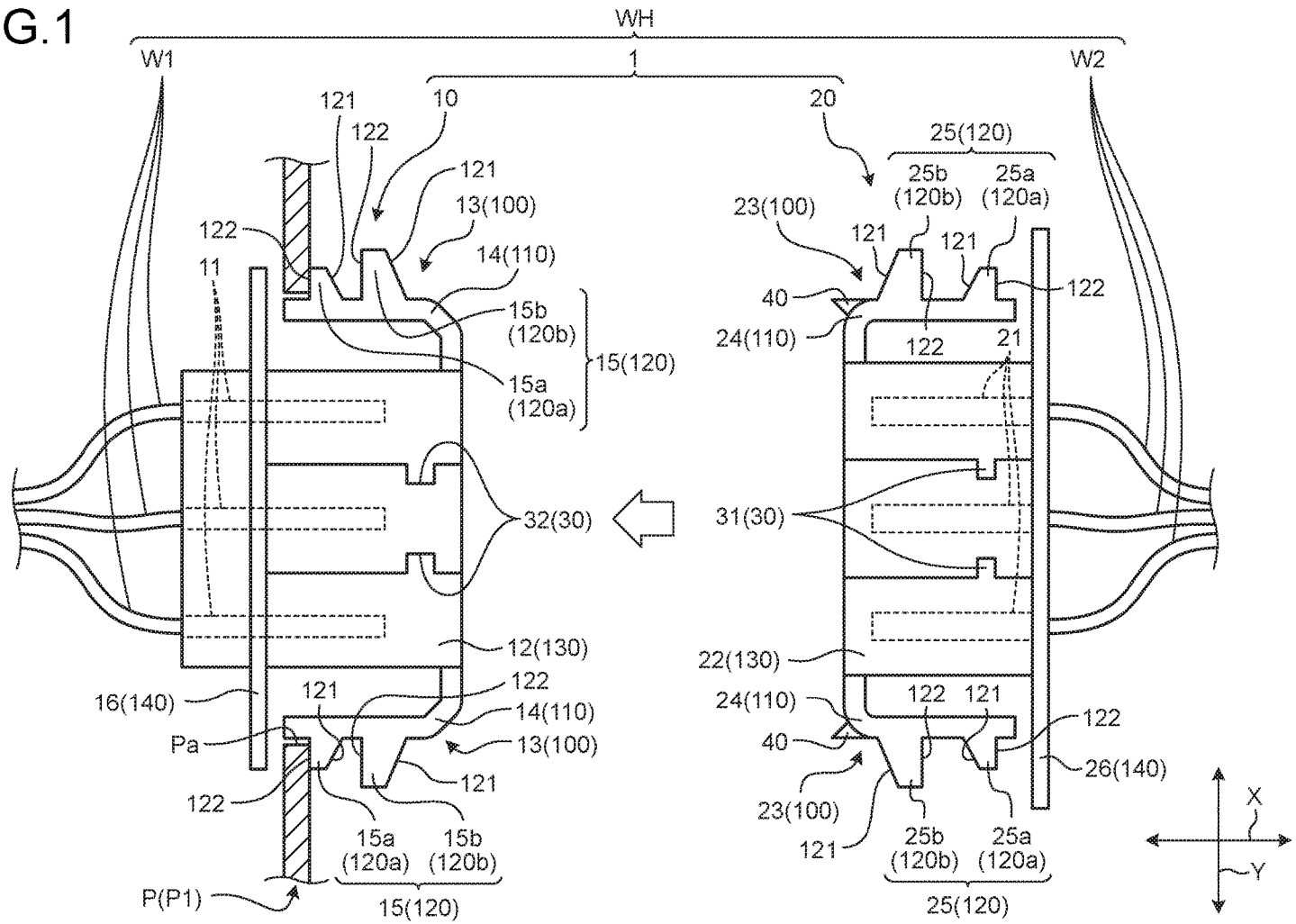
FIG. 1 is a configuration diagram that schematically illustrates the configuration of a connector mechanism according to a first embodiment.
Figure 2:
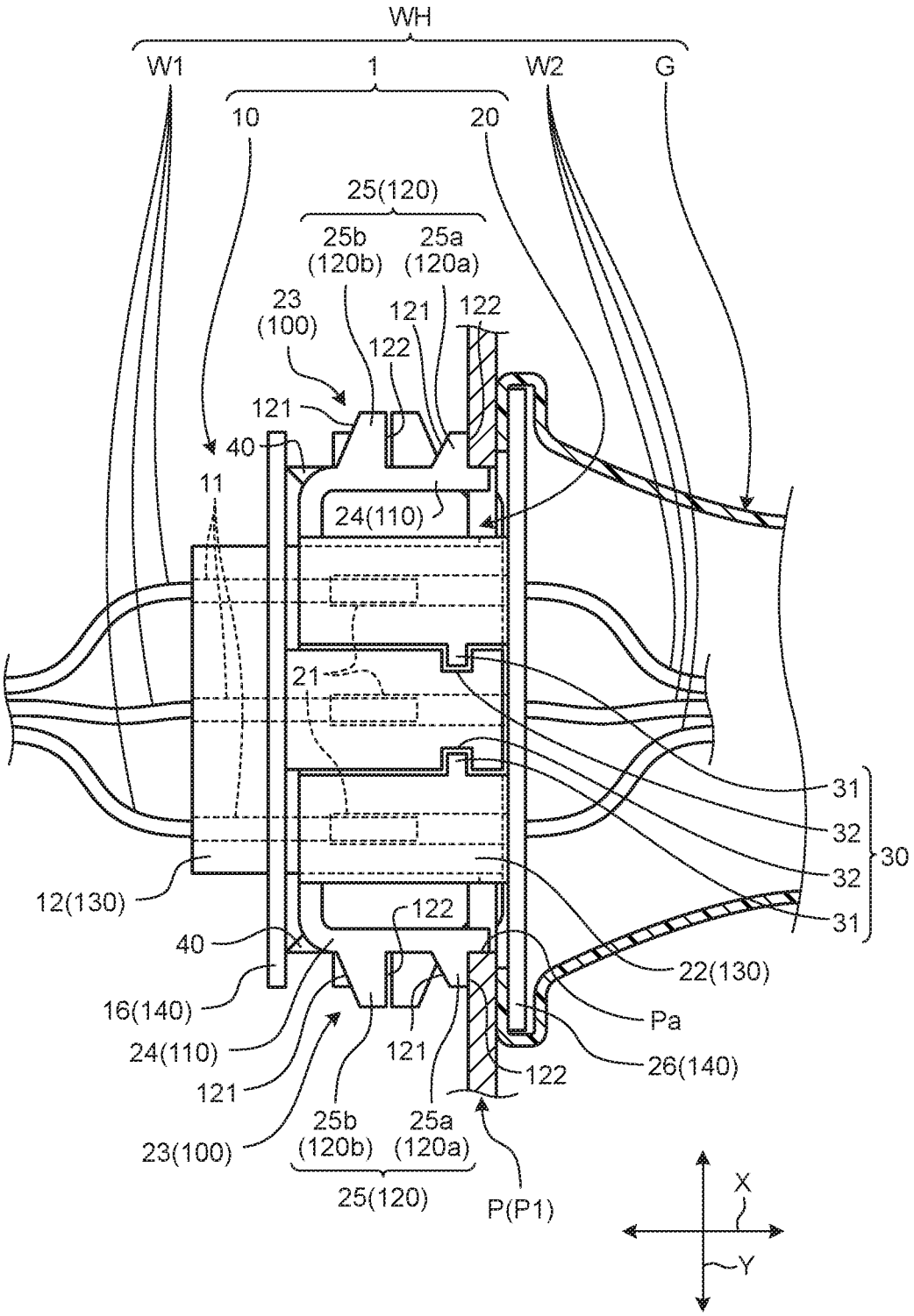
FIG. 2 is a configuration diagram that schematically illustrates the configuration of the connector mechanism according to the first embodiment.

A connector mechanism 1 of this embodiment illustrated in FIGS. 1 and 2 is used, for example, for a wire harness WH in a vehicle. The wire harness WH is a collective part configured in a manner bundling a plurality of wiring members W1 and W2, which are used for power supply and signal communication, for connection between devices mounted on a vehicle. The wire harness WH has the wiring members W1 and W2 connected to respective devices together using the connector mechanism 1 or the like. The wire harness WH includes conductive wiring members W1 and W2 and the connector mechanism 1 having the wiring members W1 and W2 connected thereto. The wire harness WH may further include a fixing member, a protector, and a later-described grommet G. Each of the wiring members W1 and W2 is configured with, for example, a metal rod in which a conductive rod member has its outer surface covered with an insulating covering unit, an electric wire in which a conductive body unit (a core) made of a plurality of conductive metal lines has its outer surface covered with an insulating covering unit, and an electric wire bundle with the electric wires bundled together.

The connector mechanism 1 in this embodiment is a connection mechanism for connection between wiring members with which the wiring member W1 and the wiring member W2 constituting the wire harness WH are connected with each other. The connector mechanism 1 includes a first connector 10 and a second connector 20. The first connector 10 includes a plurality of terminals 11 and a connector housing 12. The second connector 20 includes a plurality of terminals 21 and a connector housing 22. The terminals 11 and 21 are electrically connected to terminals of the wiring members W1 and W2 and formed from a conductive metal material. The terminals 11 and 21 are connectable with respective terminals provided to the counterpart connectors. The connector housings 12 and 22 have terminals 11 and 21 provided along the axial direction X and accommodate and retain the terminals 11 and 21. The connector housings 12 and 22 are further capable of mating with counterpart connectors and formed from an insulating resin material. The connector housing 12 mates with its counterpart connector, which is the second connector 20, and the terminal 11 is connected with its counterpart terminal, which is the terminal 21 provided to the second connector 20. The connector housing 22 mates with its counterpart connector, which is the first connector 10, and the terminal 21 is connected with its counterpart terminal, which is the terminal 11 provided to the first connector 10. In other words, the connector housing 12 constituting the first connector 10 and the connector housing 22 constituting the second connector 20 mate with each other. In this example, the first connector 10 is a male connector with the connector housing 12 retaining male terminals 11, whereas the second connector 20 is a female connector with the connector housing 22 retaining female terminals 21. In the connector mechanism 1, the connector housing 12 of the first connector 10 and the connector housing 22 of the second connector 20 mate with each other along the axial direction X and are coupled with each other. With this configuration, the terminals 11 and 21 provided to respective connector housings are electrically connected with each other, whereby electrical connection portions are formed between the terminals.

The connector mechanism 1 in this embodiment constitutes, for example, a connection mechanism connecting the wiring member W1 wired in the body side of a vehicle with the wiring member W2 wired in the door side of the vehicle. The connector mechanism 1 is a panel-mounted connector mounted on a mounting panel P disposed between a wired space in the body side and a wired space in the door side. The connector mechanism 1 in this embodiment has one of the first connector 10 and the second connector 20 serve as a standby connector and has the other one serve as an assembling connector so as to improve workability of the mating operation. In this embodiment, the first connector 10 serves as a standby connector temporarily locked to a mounting hole Pa formed in the mounting panel P disposed between the body and the door from a side (for example, from inside the body) of the mounting panel P. The second connector 20 serves as an assembling connector that mates with the first connector 10 serving as a standby connector temporarily locked to the mounting hole Pa from the other side (for example, from outside the body) of the mounting panel P and is completely locked to the mounting hole Pa. The mounting hole Pa penetrates the mounting panel P in the axial direction X, and two spaces sectioned in both sides in the axial direction X with respect to the mounting panel P communicate with each other through the mounting hole Pa. For example, the connector mechanism 1 has the first connector 10 disposed inside the vehicle and has the second connector 20 disposed outside the vehicle with respect to the mounting panel P. In the connector mechanism 1, the connector housing 22 of the second connector 20 mates with the connector housing 12 of the first connector 10 temporarily locked to the mounting hole Pa. With this process, the connector housing 12 and the connector housing 22 are locked to each other. The connector housing 12 is released from temporal lock and becomes unrestricted, whereas the connector housing 22 is completely locked to the mounting hole Pa from the other side. For implementing these functions, the connector mechanism 1 in this embodiment includes lock mechanisms 13 for temporal lock, lock mechanisms 30 for connector lock, releasing projection portions 40 for releasing the temporal lock, and lock mechanisms 23 for complete lock. The lock mechanisms 13 and 23 are capable of locking the connector housings 12 and 22 to the mounting panel P, respectively. The lock mechanisms 30 are capable of locking the connector housing 12 and the connector housing 22 to each other. The releasing projection portions 40 release lock of the lock mechanism 13 with mating operation of the connector housing 12 and the connector housing 22.

More specifically, the lock mechanism 13 for temporal lock is provided to the first connector 10 and is capable of temporarily locking the connector housing 12 to the mounting panel P. The lock mechanism 13 has the first connector 10 temporarily locked to a mounting edge portion forming the mounting hole Pa of the mounting panel P with lock beak portions 15 provided to each arm portion 14 locked to the mounting edge portion on the mounting panel P. The lock mechanisms 30 for connector lock are portions that lock the first connector 10 and the second connector 20 to each other by locking claw portions 31 locked to locked portions 32 with the first connector 10 and the second connector 20 completely mating with each other (with the terminal 11 and the terminal 21 properly electrically connected with each other). The locking claw portions 31 are provided to one of the first connector 10 and the second connector 20 (in this case, to the second connector 20), and the locked portions 32 are provided to the other one of the first connector 10 and the second connector 20 (in this case, to the first connector 10). The releasing projection portions 40 for releasing temporal lock are provided to the second connector 20 and release the connector housing 12 temporarily locked to the mounting panel P by the lock mechanism 13 from the mounting panel P with mating operation for mating the second connector 20 to the first connector 10. The releasing projection portions 40 release the lock beak portion 15 from temporal lock to the mounting edge portion of the mounting panel P by contacting with the lock beak portion 15 in a temporal lock state and having the arm portion 14 bent inward (to the body side) with the mating operation for mating the first connector 10 to the second connector 20. In this manner, the releasing projection portions 40 release the first connector 10 from temporal lock to the mounting edge portion of the mounting panel P. The lock mechanisms 23 for complete lock are provided to the second connector 20 and are capable of completely locking the connector housing 22 to the mounting panel P. The lock mechanisms 23 completely lock the second connector 20 to the mounting edge portion of the mounting panel P with lock beak portions 25 provided to each arm portion 24 locked to the mounting edge portion forming the mounting hole Pa on the mounting panel P. The arm portion 14 and the arm portion 24 are formed in respective positions not interfering with each other in the mating operation of the first connector 10 and the second connector 20.

In this embodiment, the lock mechanism 13 has a plurality of lock beak portions 15 provided to the arm portion 14 in certain positional relation, and likewise, each of the lock mechanisms 23 has a plurality of lock beak portions 25 provided to the arm portion 24 in certain positional relation. This configuration can improve adaptability of the lock mechanisms. Configurations of the lock mechanisms 13 and 23 will now be described in detail with reference to the drawings.

The lock mechanisms 13 and 23 have substantially the same basic configuration although having slight differences in the shape, the size, and others. The lock mechanisms 13 and 23 will therefore be simply referred to as a lock mechanism 100 unless distinction between them is required. Likewise, the arm portion 14 and the arm portion 24 will be simply referred to as an arm portion 110 unless distinction between them is required. The lock beak portion 15 and the lock beak portion 25 will be simply referred to as a lock beak portion 120 unless distinction between them is required. Furthermore, the connector housing 12 and the connector housing 22 will be simply referred to as a connector housing 130 unless distinction between them is required.

Figure 3:
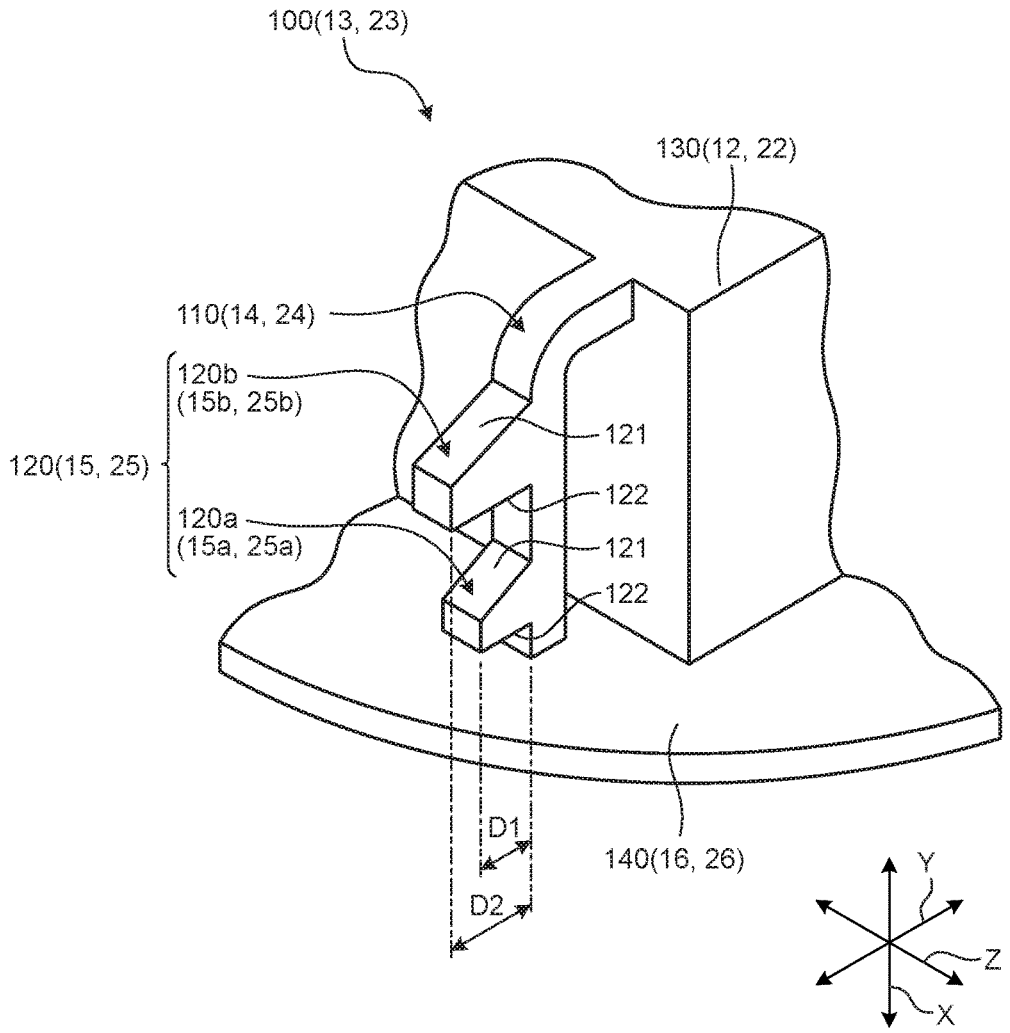
FIG. 3 is a partial perspective view that schematically illustrates a lock mechanism of a connector according to the first embodiment.

More specifically, the lock mechanism 100 includes the arm portion 110, the lock beak portion 120, and a flange portion 140 as illustrated in FIGS. 1, 2, and 3. The flange portion 140 will first be described prior to describing the arm portion 110 and the lock beak portion 120.

The flange portion 140 is formed in a manner projecting from the connector housing 130 in directions intersecting with the axial direction X, in this case, in the first width direction Y and the second width direction Z. The flange portion 140 is formed, for example, in a substantially elliptical annular and plate shape. Of the flange portion 140, the flange portion 16 constituting the first connector 10 is integrally formed with the connector housing 12 in the middle of the connector housing 12 in the axial direction X. Of the flange portion 140, the flange portion 26 constituting the second connector 20 is integrally formed with the connector housing 22 in an end of the connector housing 22 in the axial direction X, more specifically, in an end opposite to the end mating with the connector housing 12. A grommet G capable of shutting off water flow between the flange portion 26 constituting the second connector 20 and the mounting panel P is put on the flange portion 26. The flange portion 16 and the flange portion 26 will be simply referred to as the flange portion 140 unless distinction between them is required.

The arm portion 110 has a base end portion supported by the connector housing 130 in a cantilever manner and is formed in a rod shape along the axial direction X. The arm portion 110 is further provided with a plurality of lock beak portions 120. The arm portion 110 may be referred to as a lance portion provided with a plurality of lock beak portions 120 and capable of elastically change its shape along the first width direction Y. More specifically, the arm portion 110 is supported by the connector housing 130 at its base end, extended from the connector housing 130 toward the flange portion 140 side along the axial direction X, and has a free front end. The arm portion 110 is supported at its base end in a cantilever manner, which makes the arm portion 110 relatively highly flexible in an intersection direction intersecting with the axial direction X, in this case, in the first width direction Y, compared with the connector housing 130 and other parts. This configuration allows the arm portion 110 to easily elastically change its shape along the first width direction Y. In other words, the arm portion 110 is bendable along the first width direction Y. In this configuration, the arm portions 110 are formed in a pair on respective end surfaces of the connector housing 130 in the first width direction Y. Each of the arm portions 110 has the base end project from the corresponding end surface of the connector housing 130 in the first width direction Y along the first width direction Y. The arm portion 110 is further bent along the axial direction X and extended along the corresponding end surface of the connector housing 130 in the first width direction Y. The pair of arm portions 110 is provided at respective positions facing each other along the first width direction Y. The arm portion 110 is integrally formed with the connector housing 130 and is provided with a plurality of lock beak portions 120.

The lock beak portion 120 is formed in a manner projecting from the arm portion 110 toward a side opposite to the connector housing 130 side along the first width direction Y, in other words, projecting outward along the first width direction Y. The lock beak portion 120 is formed in a claw shape capable of being locked to the mounting panel P disposed between the lock beak portion 120 and the flange portion 140 in the axial direction X. More specifically, the lock beak portion 120 is formed in a substantially trapezoidal shape when viewed along the second width direction Z (in the second-width directional view). A surface of the lock beak portion 120 in the base end side of the arm portion 110 is formed as an inclined surface 121 inclined with respect to the first width direction Y. The lock beak portion 120 is inclined with the amount of projection along the first width direction Y gradually increasing from the base end side toward the front end side of the arm portion 110, whereby the inclined surface 121 is formed. Another surface of the lock beak portion 120 in the front end side of the arm portion 110 is formed as a locked surface 122 disposed parallel with the first width direction Y and locked to the mounting panel P.

In this embodiment, a plurality of lock beak portions 120 are provided along the axial direction X at certain intervals. More specifically, the lock beak portion 120 has two lock beak portions, a first lock beak portion 120*a* and a second lock beak portion 120*b*, on each arm portion 110. The first lock beak portion 120*a* is formed in the front end side of the arm portion 110 in the axial direction X, whereas the second lock beak portion 120*b* is formed in the base end side of the arm portion 110 in the axial direction X. Of the lock beak portions 120 in this embodiment, a lock beak portion 120 disposed in the front end side of the arm portion 110, which is the first lock beak portion 120*a*, has a relatively small amount of projection D1 along the first width direction Y, whereas the lock beak portion 120 disposed in the base end side of the arm portion 110, which is the second lock beak portion 120*b*, has a relatively large amount of projection D2 along the first width direction Y (D1<D2).

A plurality of lock beak portions 120, which is the first lock beak portions 120*a* and the second lock beak portions 120*b*, are provided to each of the pair of arm portions 110. More specifically, the lock beak portions 120 are formed in pairs at respective positions facing each other along the first width direction Y. The lock beak portion 15 constituting the first connector 10 has two lock beak portions, which is a first lock beak portion 15*a* corresponding to the first lock beak portion 120*a* and a second lock beak portion 15*b* corresponding to the second lock beak portion 120*b*. Likewise, the lock beak portion 25 constituting the second connector 20 has two lock beak portions, which is a first lock beak portion 25*a* corresponding to the first lock beak portion 120*a* and a second lock beak portion 25*b* corresponding to the second lock beak portion 120*b*.

The lock mechanism 100 in the above-described configuration has the connector housing 130 inserted and pushed into the mounting hole Pa formed in the mounting panel P along the axial direction X, whereby the lock beak portion 120 is locked to the mounting edge portion on the peripheral edge of the mounting hole Pa of the mounting panel P. In this process, in the lock mechanism 100, the inclined surface 121 of the lock beak portion 120 is pushed into the mounting edge portion of the mounting panel P in the state contacting with the mounting edge portion, which allows the arm portion 110 to be bent inward (to the connector housing 130 side) in the first width direction Y from the initial position and change its shape. With the lock mechanism 100 further pushed, the lock beak portion 120 climbs over the mounting edge portion of the mounting panel P from a side to the other side in the axial direction X. In the lock mechanism 100, the arm portion 110 elastically returns to the initial position side, whereby the locked surface 122 is locked to the mounting edge portion of the mounting panel P. In other words, in the lock mechanism 100, the locked surface 122 of the lock beak portion 120 is locked to the mounting edge portion of the mounting panel P with the connector housing 130 arranged in the mounting hole Pa formed in the mounting panel P, thereby restricting move of the connector housing 130 toward a direction along the axial direction X.

For example, the lock mechanism 13 constituting the first connector 10 has the connector housing 12 inserted and pushed into the mounting hole Pa from a first side in the axial direction X and has the lock beak portion 15 climb over the mounting edge portion of the mounting panel P from the first side to a second side in the axial direction X. In this process, the locked surface 122 is locked to the mounting edge portion of the mounting panel P, whereby the connector housing 12 is temporarily locked to the mounting edge portion of the mounting panel P (see FIG. 1). The lock mechanism 23 constituting the second connector 20 has the connector housing 22 inserted into the mounting hole Pa from the second side in the axial direction X, pushed into the connector housing 12 of the first connector 10 waiting in the mounting hole Pa, and mate with the connector housing 12. In this process, the lock beak portion 25 climbs over the mounting edge portion of the mounting panel P from the second side to the first side in the axial direction X, and the locked surface 122 is locked to the mounting edge portion of the mounting panel P. This process allows the connector housing 22 to be completely locked to the mounting edge portion of the mounting panel P (see FIG. 2). After this process, in the connector mechanism 1, the grommet G is put on the flange portion 26 constituting the second connector 20.

The lock mechanism 100 in this embodiment has a plurality of lock beak portions 120 provided to the arm portion 110 along the axial direction X at certain intervals. This configuration allows the lock mechanism 100 to be adaptable to a plurality of types of mounting panels P having different thicknesses and to properly lock the connector housing 130 to the mounting edge portion of the mounting panel P, which is disposed between the locked surface 122 of the lock beak portion 120 and the flange portion 140. In other words, the lock mechanism 100 is able to properly lock the connector housing 130 to the mounting edge portion of the mounting panel P even when used for a part with a mounting panel having a different thickness.

For example, as illustrated in FIG. 2, when the lock mechanism 100 locks the connector housing 130 to a mounting panel P1, that is disposed between the locked surface 122 of the lock beak portion 120 and the flange portion 140 and has a relatively small thickness of the mounting panel P, the first lock beak portion 120*a* is locked to the mounting edge portion of the mounting panel P1. In this case, in the lock mechanism 100, the locked surface 122 of the first lock beak portion 120*a*, of a plurality of lock beak portions 120, disposed in the front end side of the arm portion 110, in other words, disposed in the flange portion 140 side of the connector housing 130 and having a relatively small distance from the flange portion 140 is locked to the mounting edge portion of the mounting panel P1. In this manner, the connector housing 130 is locked to the mounting edge portion of the mounting panel P1.

Figure 4:
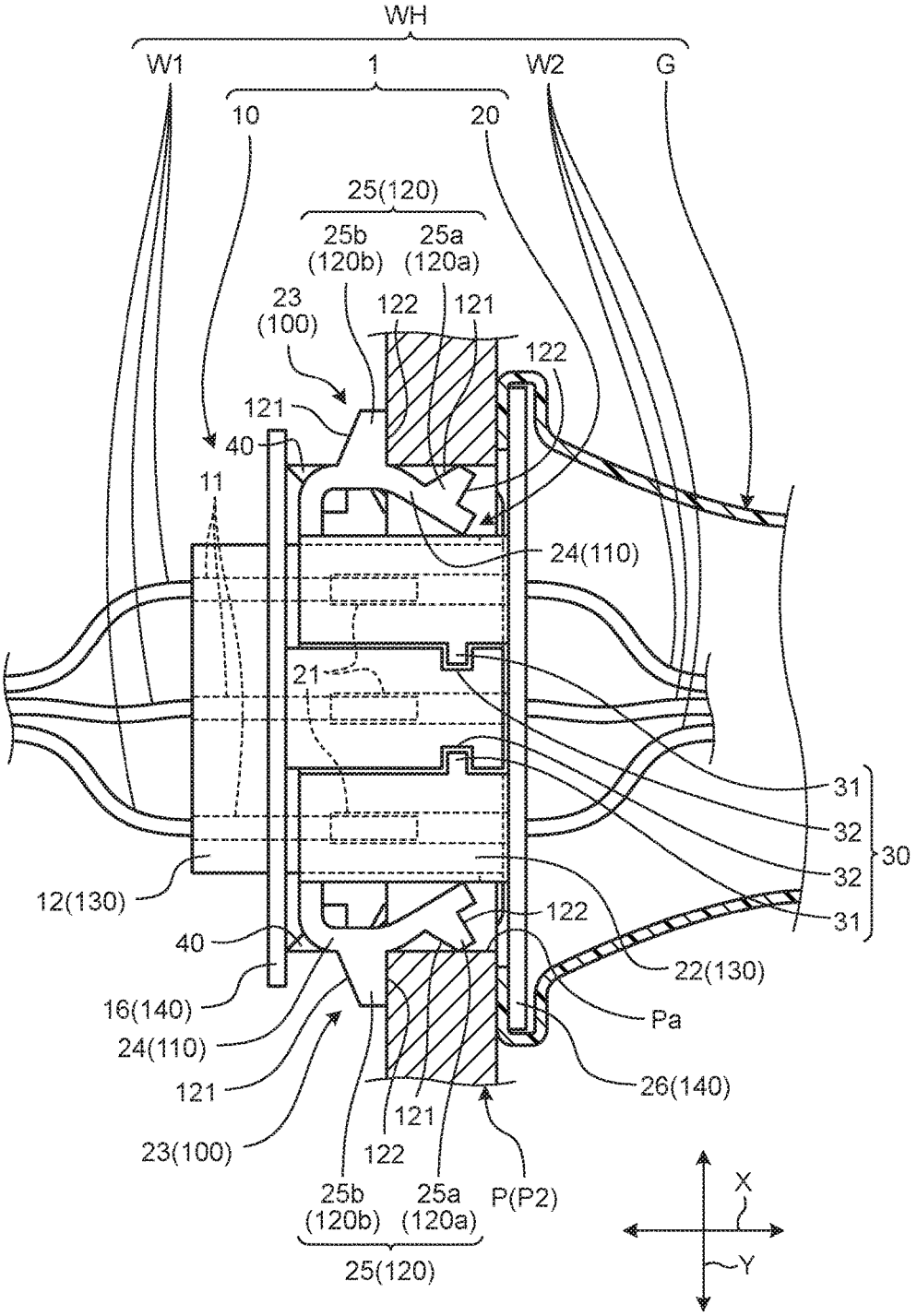
FIG. 4 is an illustrative configuration diagram for operation of the lock mechanism in the connector mechanism according to the first embodiment.

In another case, as illustrated in FIG. 4, when the lock mechanism 100 locks the connector housing 130 to a mounting panel P2 that is disposed between the locked surface 122 of the lock beak portion 120 and the flange portion 140 and has a relatively large thickness of the mounting panel P, the second lock beak portion 120*b* is locked to the mounting edge portion of the mounting panel P2. In this case, in the lock mechanism 100, the locked surface 122 of the second lock beak portion 120*b*, of a plurality of lock beak portions 120, disposed in the base end side of the arm portion 110, in other words, disposed in a side opposite to the flange portion 140 side of the connector housing 130 and having a relatively large distance from the flange portion 140 is locked to the mounting edge portion of the mounting panel P2. In this manner, the connector housing 130 is locked to the mounting edge portion of the mounting panel P2. In the lock mechanism 100, the first lock beak portion 120*a* is disposed inside the mounting edge portion of the mounting panel P2, in other words, on the inner peripheral surface of the mounting hole Pa, which renders the arm portion 110 slightly bent inward in the first width direction Y.

In FIGS. 2 and 4, the lock mechanism 23 constituting the second connector 20 is depicted for describing exemplary operation of the lock mechanism for a plurality of types of mounting panels P having different thicknesses. The lock mechanism 13 constituting the first connector 10 operates for a plurality of types of mounting panels P having different thicknesses in substantially the same manner.

The lock mechanism 100, the connector mechanism 1, and the wire harness WH described as above are adaptable to a plurality of types of mounting panels P having respective different thicknesses and can properly lock the connector housing 130 to the mounting panel P, which is positioned between the lock beak portion 120 and the flange portion 140, with a plurality of lock beak portions 120 provided to the arm portion 110 along the axial direction X at certain intervals. With the lock mechanism 100, the connector mechanism 1, and the wire harness WH, the connector housing 130 can be properly locked to the mounting panel P even when the lock mechanism 100 is shared between mounting panels P having respective different thicknesses. This configuration can therefore improve adaptability of the lock mechanism 100.

Furthermore, with the lock mechanism 100, the connector mechanism 1, and the wire harness WH, even when the lock mechanism 100 and the connector mechanism 1 are used for a part with a mounting panel P having a different thickness, the connector housing 130 can be properly locked to the mounting edge portion of the mounting panel P with less shaking. With this configuration, the grommet G put on the flange portion 26 of the connector housing 22 can appropriately protect the mounting panels P having different thicknesses from water flow. With the lock mechanism 100, the connector mechanism 1, and the wire harness WH, the grommet G shared between the mounting panels P having different thicknesses can still appropriately protect the mounting panels P from water flow, which can accordingly improve adaptability of the grommet G.

Figure 5:
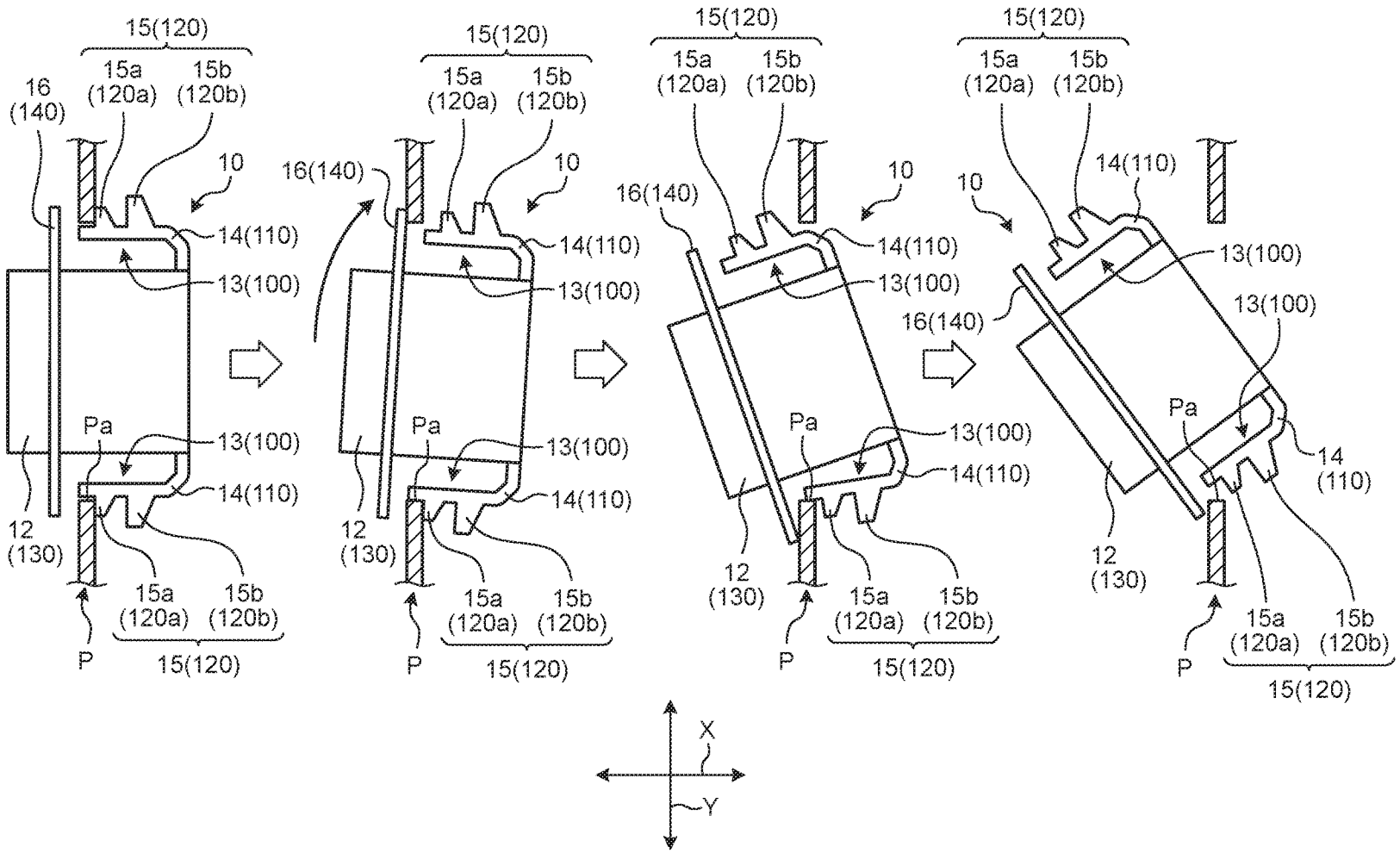
FIG. 5 is an illustrative schematic flow diagram for operation of the connector according to the first embodiment.

With the lock mechanism 100, the connector mechanism 1, and the wire harness WH described as above, the locked surface 122 of the lock beak portion 120 provided to each of the pair of arm portions 110 is locked to the mounting edge portion of the mounting panel P with the connector housing 130 disposed in the mounting hole Pa formed in the mounting panel P. As illustrated in FIG. 5, the whole of the connector housing 12 is drawn to a side in the axial direction X in a manner tilted from the flange portion 16 side along the first width direction Y. With this process, the first connector 10 can be detached from the mounting hole Pa by using bending of each arm portion 14 and releasing locking between the lock beak portion 15 and the mounting edge portion of the mounting panel P in a stepwise manner. For example, the first connector 10 tilts the whole of the connector housing 12 to a side in the first width direction Y, thereby releasing locking between the lock beak portion 15 positioned in this side and the mounting edge portion of the mounting panel P. The first connector 10 further rotates and tilts the whole of the connector housing 12 to the other side in the first width direction Y, thereby releasing locking between the lock beak portion 15 in the other side and the mounting edge portion of the mounting panel P. Consequently, the first connector 10 can be detached from the mounting hole Pa of the mounting panel P without using a specific release tool or the like, which can improve workability, for example, in the detaching process. The same case applies to the second connector 20.

With the lock mechanism 100, the connector mechanism 1, and the wire harness WH described as above, the first lock beak portion 120*a* positioned in the front end side of the arm portion 110 has a relatively small amount of projection D1, whereas the second lock beak portion 120*b* positioned in the base end side of the arm portion 110 has a relatively large amount of projection D2. With the lock mechanism 100, the connector mechanism 1, and the wire harness WH, this formation can assure an appropriate overlapping depth between the locked surface 122 and the mounting edge portion of the mounting panel P in both cases with the first lock beak portion 120*a* locked to the mounting panel P1 having a relatively small thickness and with the second lock beak portion 120*b* locked to the mounting panel P2 having a relatively large thickness.

Second Embodiment

A lock mechanism, a connector, and a wire harness according to a second embodiment are different from those according to the first embodiment in that an arm portion penetrates a flange portion. Like numerals indicate like components in the above-described embodiment, and description about the same configuration, actions, and advantageous effects will be omitted as much as possible, which will apply to the other embodiments.

Figure 6:
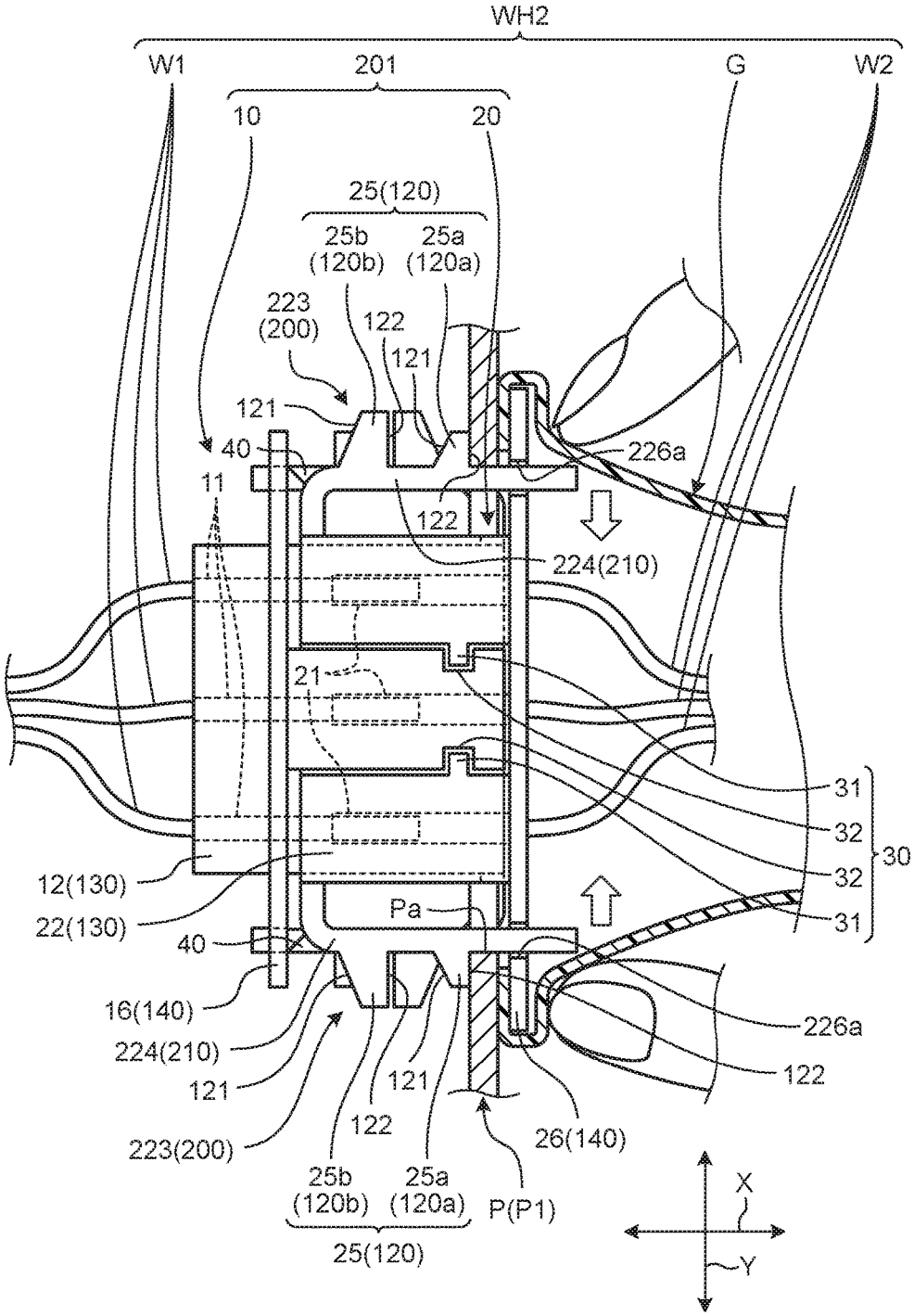
FIG. 6 is a configuration diagram that schematically illustrates the configuration of a connector mechanism according to a second embodiment.
Figure 7:
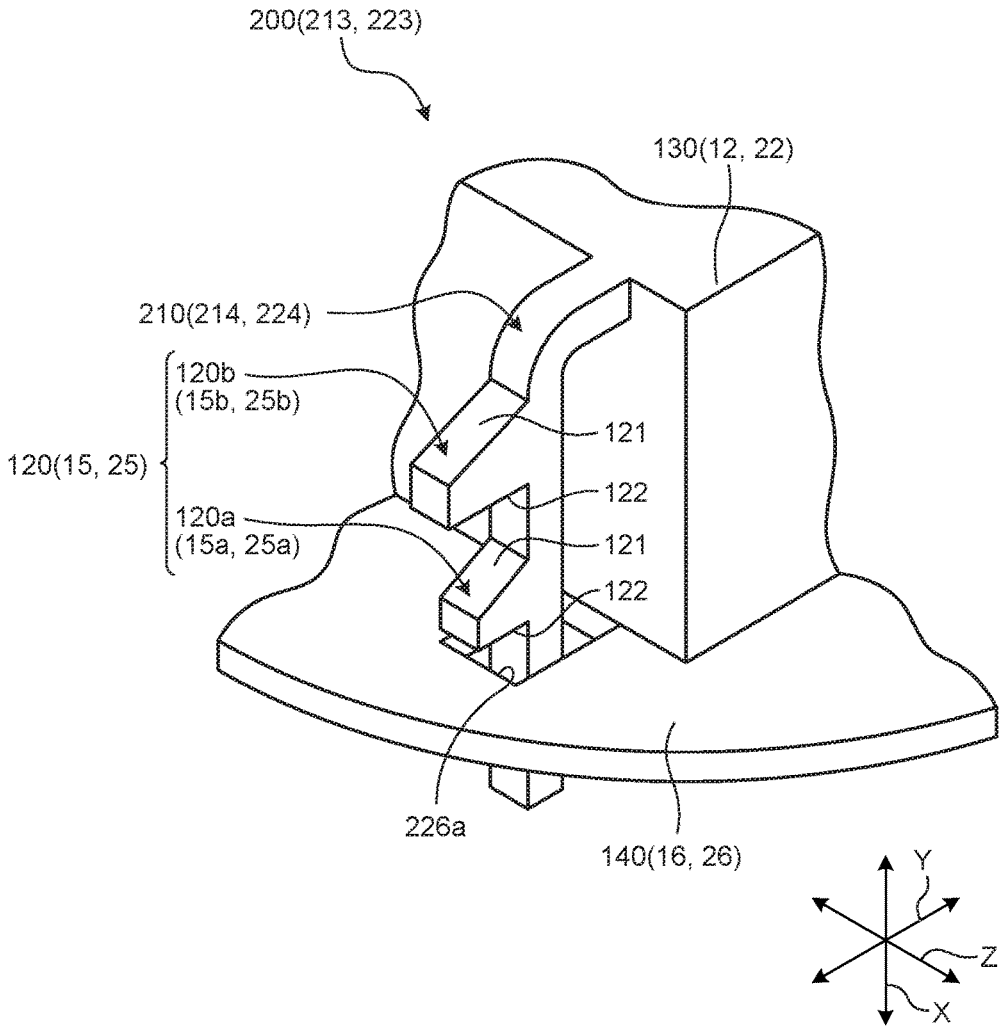
FIG. 7 is a partial perspective view that schematically illustrates a lock mechanism of a connector according to the second embodiment.

A wire harness WH2 of this embodiment illustrated in FIGS. 6 and 7 is different from the above-described wire harness WH in that a connector mechanism 201 replaces the connector mechanism 1, and other configurations are substantially the same as those of the wire harness WH. The connector mechanism 201 is different from the above-described connector mechanism 1 in that a lock mechanism 200 replaces the lock mechanism 100, and other configurations are substantially the same as those of the connector mechanism 1. As the lock mechanism 200, the first connector 10 includes a lock mechanism 213 replacing the lock mechanism 13. Likewise, the second connector 20 includes a lock mechanism 223 replacing the lock mechanism 23 as the lock mechanism 200. The lock mechanism 200 is different from the above-described lock mechanism 100 in that an arm portion 210 replaces the arm portion 110, and other configurations are substantially the same as those of the lock mechanism 100. As the arm portion 210, the lock mechanism 213 includes an arm portion 214 replacing the arm portion 14. Similarly, the lock mechanism 223 includes an arm portion 224 replacing the arm portion 24 as the arm portion 210. The lock mechanism 213 and the lock mechanism 223 will be simply referred to as the lock mechanism 200 unless distinction between them is required. Likewise, the arm portion 214 and the arm portion 224 will be simply referred to as the arm portion 210 unless distinction between them is required.

The grommet G contacting with the mounting panel P and is capable of shutting off water flow between the flange portion 140 (the flange portion 16 and the flange portion 26) in this embodiment and the mounting panel P is put on the flange portion 140. The flange portion 140 in this embodiment further includes through-holes 226*a* for having the arm portions 210 penetrate along the axial direction X. The through-hole 226*a* is formed in a manner penetrating the flange portion 140 along the axial direction X and formed in a position facing each arm portion 210 in the axial direction X. The through-hole 226*a* illustrated in FIGS. 6 and 7 is formed in a substantially rectangular shape having a cross-sectional surface perpendicular to the axial direction X larger than the cross-sectional surface of the arm portion 210; however, the shape is not limited thereto. The through-hole 226*a* may have a substantially circular cross-sectional surface.

The arm portion 210 in this embodiment penetrates through the mounting hole Pa and the through-hole 226*a* along the axial direction X and has the base end disposed in a side in the axial direction X with respect to the mounting panel P and has the front end disposed in the other side in the axial direction X with respect to the mounting panel P with the lock beak portion 120 locked to the mounting panel P. The arm portion 210 in this embodiment is formed in a manner having the front end in the axial direction X passing through the through-hole 226*a* and exposed to a side opposite to the side with the lock beak portion 120 and others. For example, the front end of the arm portion 224 constituting the second connector 20 is disposed inside the grommet G with the grommet G arranged on the flange portion 26. The front end of the arm portion 224 serves as an operation unit for releasing locking between the lock beak portion 120 and the mounting edge portion of the mounting panel P.

The above-described lock mechanism 200, the connector mechanism 201, and the wire harness WH2 have a plurality of lock beak portions 120 provided to the arm portion 110 along the axial direction X at certain intervals. This configuration can improve adaptability.

Furthermore, the above-described lock mechanism 200, the connector mechanism 201, and the wire harness WH2 have the front end of the arm portion 210 penetrate through the through-hole 226*a* formed in the flange portion 140. This configuration allows a user to easily release locking between the lock beak portion 120 and the mounting edge portion of the mounting panel P and detach the connector housing 130 from the mounting hole Pa by, for example, pinching the front ends of the arm portions 210 from outside the grommet G with fingers as illustrated in FIG. 6 and bending the arm portions 210.

The lock mechanisms, the connectors, and the wire harnesses according to the above-described embodiments of the present invention are not limited to those in the above-described embodiments, and various changes can be made within the scope of the appended claims. The lock mechanism, the connector, and the wire harness according to this embodiment may be configured in a manner combining the components described in the embodiments and the modifications as appropriate.

The first connector 10 has been described as a male connector with the connector housing 12 retaining male terminals 11, whereas the second connector 20 has been described as a female connector with the connector housing 22 retaining female terminals 21; however, the embodiment is not limited to this assignment. The first connector 10 may be a female connector, and the second connector 20 may be a male connector.

Furthermore, the first connector 10 has been described as a standby connector, whereas the second connector 20 has been described as an assembling connector; however, the embodiments are not limited to this assignment.

Each of the pair of arm portions 110 and the pair of arm portions 210 is provided to a corresponding pair of end surfaces of the connector housing 130 in the first width direction Y; however, the arm portions are not necessarily formed in a pair.

Each of the arm portions 110 and 210 may be provided with three or more lock beak portions 120. This configuration can further increase the number of types of applicable mounting panels P having respective different thicknesses.

In the above-described embodiments, of a plurality of lock beak portions 120, the lock beak portion 120 disposed in the front end side of the arm portion 110 has a relatively small amount of projection D1, whereas the lock beak portion 120 disposed in the base end side of the arm portion 110 has a relatively large amount of projection D2; however, the embodiments are not limited to this configuration. The amount of projection D1 and the amount of projection D2 may be equal to each other. In another case, the amount of projection D1 may be relatively large, whereas the amount of projection D2 may be relatively small.

Figure 8:
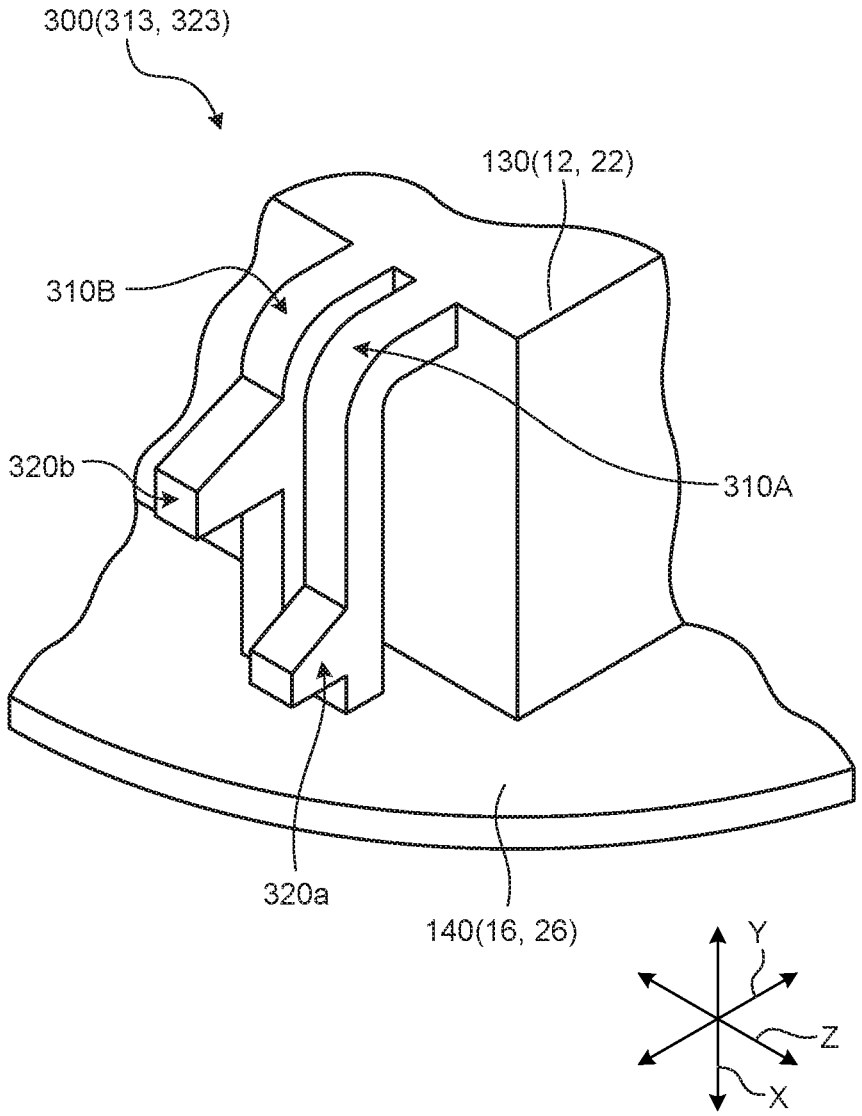
FIG. 8 is a partial perspective view that schematically illustrates a lock mechanism of a connector according to a reference example.

FIG. 8 is a drawing that illustrates a lock mechanism 300 according to a reference example. A lock mechanism 300 according to the reference example properly locks the connector housing 130 to the mounting panels P having different thicknesses and thus has a configuration different from those of the above-described lock mechanisms 100 and 200. The first connector 10 according to the reference example includes a lock mechanism 313 replacing the lock mechanisms 13 and 213 as the lock mechanism 300. The second connector 20 according to the reference example includes a lock mechanism 323 replacing the lock mechanisms 23 and 223 as the lock mechanism 300. The lock mechanism 300 has two arm portions 310A and 310B formed at each end surface of the connector housing 130 in the first width direction Y. The arm portion 310A and the arm portion 310B are provided to each of the end surfaces of the connector housing 130 in the first width direction Y. The arm portion 310A and the arm portion 310B have a lock beak portion 320*a* and a lock beak portion 320*b*, respectively. The lock beak portion 320*a* is provided to the arm portion 310A, and the lock beak portion 320*b* is provided to the arm portion 310B. The lock beak portion 320*a* and the lock beak portion 320*b* are formed in positions different from each other in the axial direction X on the respective arm portions 310A and 310B. The lock beak portion 320*a* is disposed in the front end side of the arm portion 310A, in other words, in the flange portion 140 side of the connector housing 130. The lock beak portion 320*a* is formed in a position the distance of which from the flange portion 140 is relatively small. On the other hand, the lock beak portion 320*b* is disposed in the base end side of the arm portion 310B, in other words, in a side opposite to the flange portion 140 side of the connector housing 130. The lock beak portion 320*b* is formed in a position the distance of which from the flange portion 140 is relatively large. The lock mechanism 300 of this embodiment is used with one of the arm portion 310A and the arm portion 310B folded on its base end and removed and with the other one left according to the thickness of the adapted mounting panel P. For example, for the mounting panel P1 (see FIG. 2 and other drawings) having a relatively small thickness, the lock mechanism 300 is used with the arm portion 310A left and with the arm portion 310B folded on its base end and removed. In another case, for the mounting panel P2 (see FIG. 4 and other drawings) having a relatively large thickness, the lock mechanism 300 is used with the arm portion 310B left and with the arm portion 310A folded on its base end and removed. In this manner, the lock mechanism 300 according to the reference example having a configuration different from those of the earlier-described lock mechanisms 100 and 200 can properly lock the connector housing 130 to mounting panels P having different thicknesses.

The lock mechanism, the connector, and the wire harness according to the present embodiment have a plurality of lock beak portions provided to each arm portion along the axial direction at certain intervals. This configuration allows the lock mechanism, the connector, and the wire harness to be adaptable to a plurality of types of mounting panels having different thicknesses and to properly lock the connector housing to the mounting panel, which is disposed between the lock beak portion and the flange portion. This configuration therefore exerts advantageous effects in improving adaptability of the lock mechanism, the connector, and the wire harness.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A lock mechanism comprising:

a flange portion that is formed in a manner projecting from a connector housing provided with a terminal along an axial direction and being capable of mating with a counterpart connector in an intersection direction intersecting with the axial direction;

an arm portion that is supported by the connector housing at a base end, is extended from the connector housing to the flange portion side along the axial direction, has a free front end, and is bendable along the intersection direction; and a lock beak portion that projects from the arm portion to a side opposite to the connector housing side along the intersection direction, and is lockable to a mounting panel disposed between the lock beak portion and the flange portion in the axial direction, wherein the lock beak portion includes a plurality of lock beak portions provided along the axial direction at a certain interval.

2. The lock mechanism according to claim 1, wherein the arm portion includes arm portions provided in a pair along the intersection direction in a manner facing each other, the plurality of lock beak portions are provided to each of the pair of arm portions, and each of the lock beak portions is locked to the mounting panel in a state where the connector housing is inserted in a mounting hole formed in the mounting panel.

3. The lock mechanism according to claim 2, wherein out of the lock beak portions, the lock beak portion disposed in the front end side has a relatively small amount of projection, and the lock beak portion disposed in the base end side has a relatively large amount of projection.

4. The lock mechanism according to claim 3, wherein the flange portion includes a portion defining a through-hole through which the arm portion penetrates along the axial direction, and in a state where the lock beak portion is locked to the mounting panel, the arm portion penetrates through a mounting hole formed in the mounting panel and the through-hole along the axial direction, has the base end disposed in a side of the axial direction with respect to the mounting panel, and has the front end disposed in another side of the axial direction with respect to the mounting panel.

5. The lock mechanism according to claim 1, wherein out of the lock beak portions, the lock beak portion disposed in the front end side has a relatively small amount of projection, and the lock beak portion disposed in the base end side has a relatively large amount of projection.

6. The lock mechanism according to claim 2, wherein the flange portion includes a portion defining a through-hole through which the arm portion penetrates along the axial direction, and in a state where the lock beak portion is locked to the mounting panel, the arm portion penetrates through a mounting hole formed in the mounting panel and the through-hole along the axial direction, has the base end disposed in a side of the axial direction with respect to the mounting panel, and has the front end disposed in another side of the axial direction with respect to the mounting panel.

7. The lock mechanism according to claim 5, wherein the flange portion includes a portion defining a through-hole through which the arm portion penetrates along the axial direction, and in a state where the lock beak portion is locked to the mounting panel, the arm portion penetrates through a mounting hole formed in the mounting panel and the through-hole along the axial direction, has the base end disposed in a side of the axial direction with respect to the mounting panel, and has the front end disposed in another side of the axial direction with respect to the mounting panel.

8. The lock mechanism according to claim 1, wherein the flange portion includes a portion defining a through-hole through which the arm portion penetrates along the axial direction, and in a state where the lock beak portion is locked to the mounting panel, the arm portion penetrates through a mounting hole formed in the mounting panel and the through-hole along the axial direction, has the base end disposed in a side of the axial direction with respect to the mounting panel, and has the front end disposed in another side of the axial direction with respect to the mounting panel.

9. A connector comprising:

a connector housing that is provided with a terminal along an axial direction and is matable with a counterpart connector; and a lock mechanism that is capable of locking the connector housing to a mounting panel, wherein the lock mechanism includes:

a flange portion that is formed in a manner projecting from the connector housing in an intersection direction intersecting with the axial direction;

an arm portion that is supported by the connector housing at a base end, is extended from the connector housing to the flange portion side along the axial direction, has a free front end, and is bendable along the intersection direction; and a lock beak portion that projects from the arm portion to a side opposite to the connector housing side along the intersection direction, and is lockable to the mounting panel disposed between the lock beak portion and the flange portion in the axial direction, and the lock beak portion includes a plurality of lock beak portions provided along the axial direction at a certain interval.

10. A wire harness comprising:

a conductive wiring member; and a connector that is connected with the wiring member, wherein the connector includes:

a connector housing that is provided with a terminal connected with the wiring member along an axial direction and is matable with a counterpart connector; and a lock mechanism that is capable of locking the connector housing to a mounting panel, the lock mechanism includes:

a flange portion that is formed in a manner projecting from the connector housing in an intersection direction intersecting with the axial direction;

an arm portion that is supported by the connector housing at a base end, is extended from the connector housing to the flange portion side along the axial direction, has a free front end, and is bendable along the intersection direction; and a lock beak portion that projects from the arm portion to a side opposite to the connector housing side along the intersection direction, and is lockable to the mounting panel disposed between the lock beak portion and the flange portion in the axial direction, and the lock beak portion includes a plurality of lock beak portions provided along the axial direction at a certain interval.

* * * * *